US005346211A

United States Patent [19]

Ou et al.

[11] Patent Number: 5,346,211

[45] Date of Patent: Sep. 13, 1994

[54] GAME RACKET

[76] Inventors: Li-Min Ou; Chien-Der Lin, both of No. 1-3, Lane 251, Tong-Yeang Rd., Feng-Yuan City, Taichung, Taiwan

[21] Appl. No.: 80,812

[22] Filed: Jun. 24, 1993

[51] Int. Cl.[5] ..... A63B 51/04

[52] U.S. Cl. ..... 273/73 C; 273/73 D

[58] Field of Search ..... 273/73 R, 73 C, 73 A, 273/73 D, 73 F, 73 L

[56] References Cited

U.S. PATENT DOCUMENTS

| | | | |
|---|---|---|---|
| 2,969,984 | 1/1961 | Presnick | 273/73 L |
| 3,934,876 | 1/1976 | Haddad | 273/73 C |
| 4,974,845 | 12/1970 | Umlauft et al. | 273/73 C |
| 5,158,285 | 10/1992 | Flam | 273/73 A |

FOREIGN PATENT DOCUMENTS

| | | | |
|---|---|---|---|
| 1051701 | 2/1959 | Fed. Rep. of Germany | 273/73 C |
| 1503812 | 12/1967 | France | 273/73 C |
| 293819 | 7/1928 | United Kingdom | 273/73 C |

*Primary Examiner*—William E. Stoll

*Attorney, Agent, or Firm*—Browdy and Neimark

[57] ABSTRACT

A game racket has a head frame comprising a network made of a plastic material of excellent elasticity and structural strength by injection molding. The network of the head frame is composed of a wrapping portion and a ball-striking portion. The wrapping portion has a width sufficient to wrap up the head frame while the ball-striking portion is formed by a plurality of horizontal strings and longitudinal strings of the wrapping portion, which interlace vertically one another. The head frame is therefore devoid of the string holes.

17 Claims, 5 Drawing Sheets

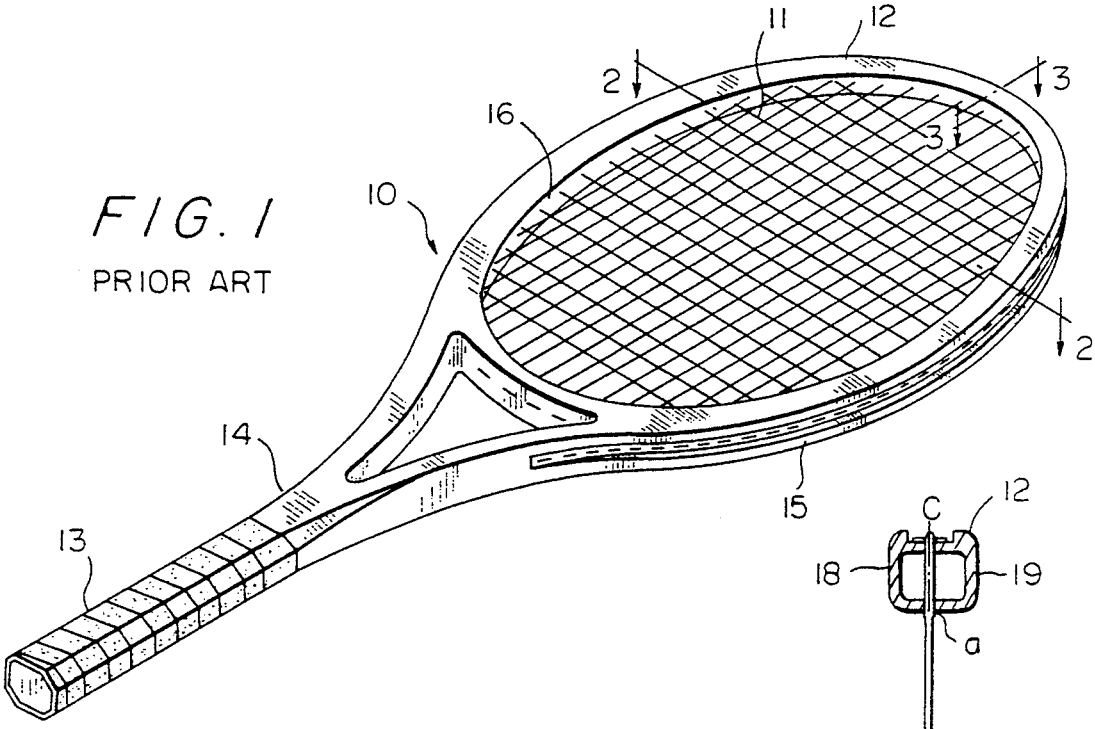
FIG. 1
PRIOR ART
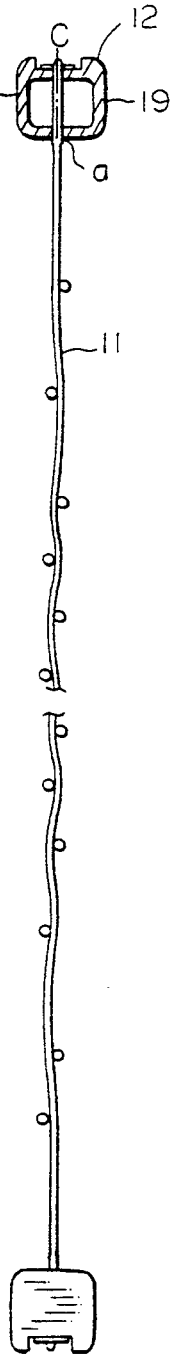
FIG. 2
PRIOR ART
FIG. 3
PRIOR ART
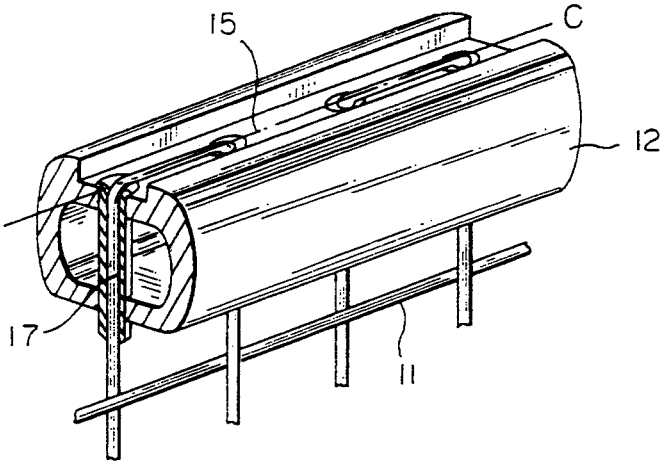

GAME RACKET

BACKGROUND OF THE INVENTION

The present invention relates generally to a game racket, and more particularly to a game racket which is provided with an innovative strung surface and is intended for use in playing tennis, badminton, squash and the like.

As shown in FIGS. 1–3, a game racket 10 of the prior art comprises a head frame 12 having a ball-striking surface 11 formed by the strings that are strung horizontally and longitudinally across the head frame 12. The game racket 10 further comprises a hand grip 13 for use in holding the game racket 10 by the user and a shaft 14 located between the head frame 12 and the hand grip 13. As shown in FIGS. 2 and 3, the head frame 12 comprises a plurality of string holes, which are disposed along a center line C of an outer frame 15 of the head frame 12 in such a manner that the string holes pass through an inner frame 16 of the head frame 12. Each of the string holes has a grommet 17 inserted thereinto. The ball-striking surface 11 of a flat network is formed by the strings that are strung horizontally and longitudinally through the corresponding grommets 17 by means of a human laborer or stringing machine. It is apparent that the overall cost of making the prior art game racket 10 is rather high in view of the fact that it is time-consuming and expensive to drill the string holes in the head frame 12 of the game racket 10.

SUMMARY OF THE INVENTION

It is therefore the primary objective of the present invention to provide a game racket with a head frame devoid of the string holes, so as to economize the production of the game racket.

The head frame of the game racket of the present invention is composed of a network made of a plastic material of excellent elasticity and structural strength by injection molding. The network is composed of a wrapping portion and a ball-striking portion. The wrapping portion has a width sufficient to wrap up the head frame while the ball-striking portion is formed by a plurality of strings which interlace horizontally and longitudinally.

The feature and the objective of the present invention can be better understood by studying the following preferred embodiments, in conjunction with the drawings provided herein.

BRIEF DESCRIPTION OF THE DRAWINGS

FIG. 1 shows a perspective view of a game racket of the prior art;

FIG. 2 shows a sectional view of a portion taken along the line 2—2 as shown in FIG. 1;

FIG. 3 shows a sectional view of a portion taken along the line 3—3 as shown in FIG. 1;

DETAILED DESCRIPTION OF THE INVENTION

Figure 4:
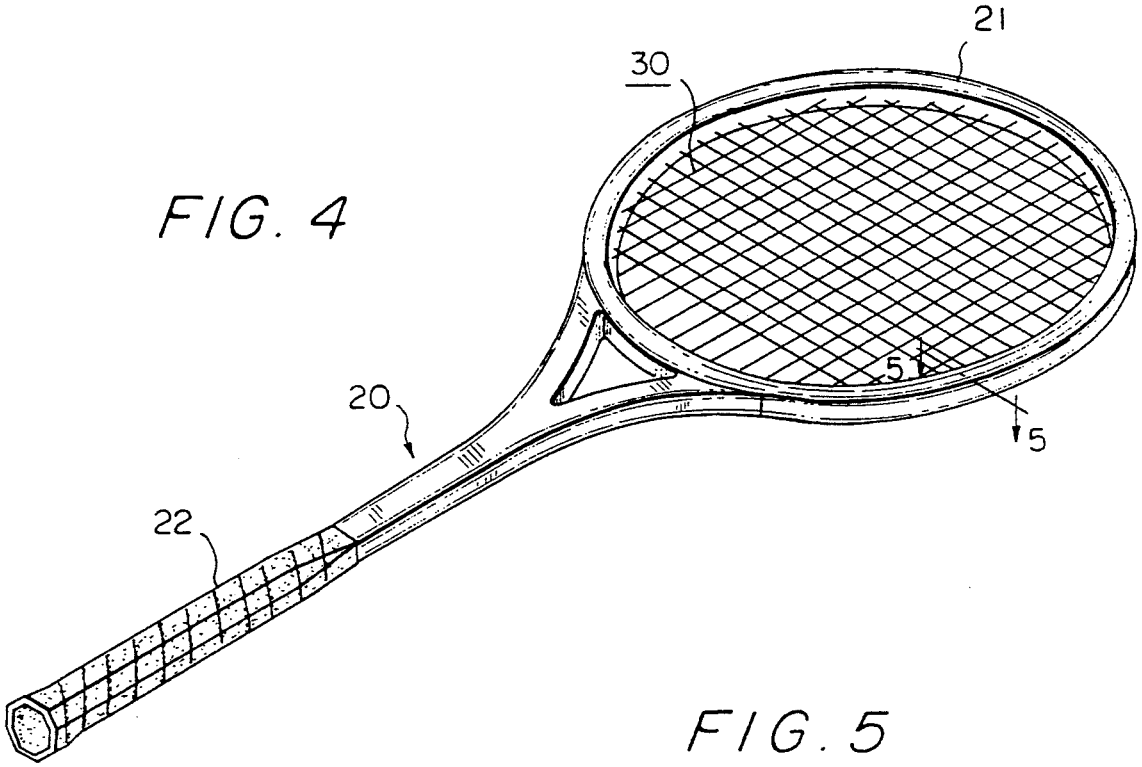
FIG. 4 shows a perspective view of a first preferred embodiment of the present invention.
Figure 5:
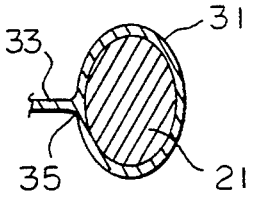
FIG. 5 shows a sectional view of a portion taken along the line 5—5 as shown in FIG. 4.
Figure 6:
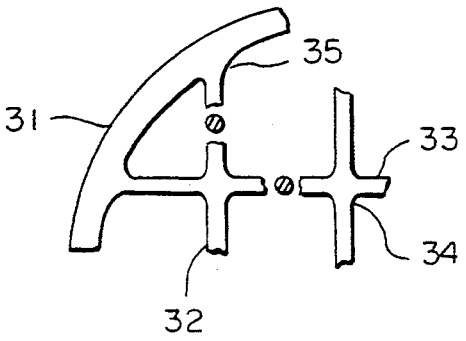
FIG. 6 is a schematic view showing the structure of a network of the game racket of the present invention.

Referring to FIGS. 4–6, a game racket 20 of the first preferred embodiment of the present invention is shown comprising a head frame 21 of circular construction and a handle 22 extending for a predetermined length from the center of a bottom portion of the head frame 21.

In the process of making the game racket 20 of the present invention, a ready-made head frame 21 is arranged in a molding tool in which the head frame 21 is provided by injection molding with a network 30 of a plastic material having properties of excellent elasticity, flexibility and impact resistance. The network 30 has a wrapping portion 31 of an appropriate thickness and an appropriate strength, as shown in FIG. 5. The wrapping portion 31 is used to wrap up entirely the head frame 21. In addition, the network 30 has a ball-striking portion formed by a plurality of longitudinal strings 32 and horizontal strings 33, which interlace one another, as shown in FIG. 6. Located at each of the four corners of each intersection, where the longitudinal string 32 and the horizontal string 33 meet, is a reinforcing portion 34 of arcuate construction. In addition, a reinforcing portion 35 of arcuate construction is disposed at a place where the longitudinal string 32 and the inner circumference of the wrapping portion 31 meet. Similarly, a reinforcing portion 35 of arcuate construction is disposed at a place where the horizontal string 33 and the inner circumference of the wrapping portion 31 meet, Both the longitudinal string 32 and the horizontal string 33 have similarly a circular cross section.

The head frame 21 of the present invention is free from the string holes. As a result, the game racket 20 can be made at a relatively faster pace and in quantity at a low cost.

Figure 7:
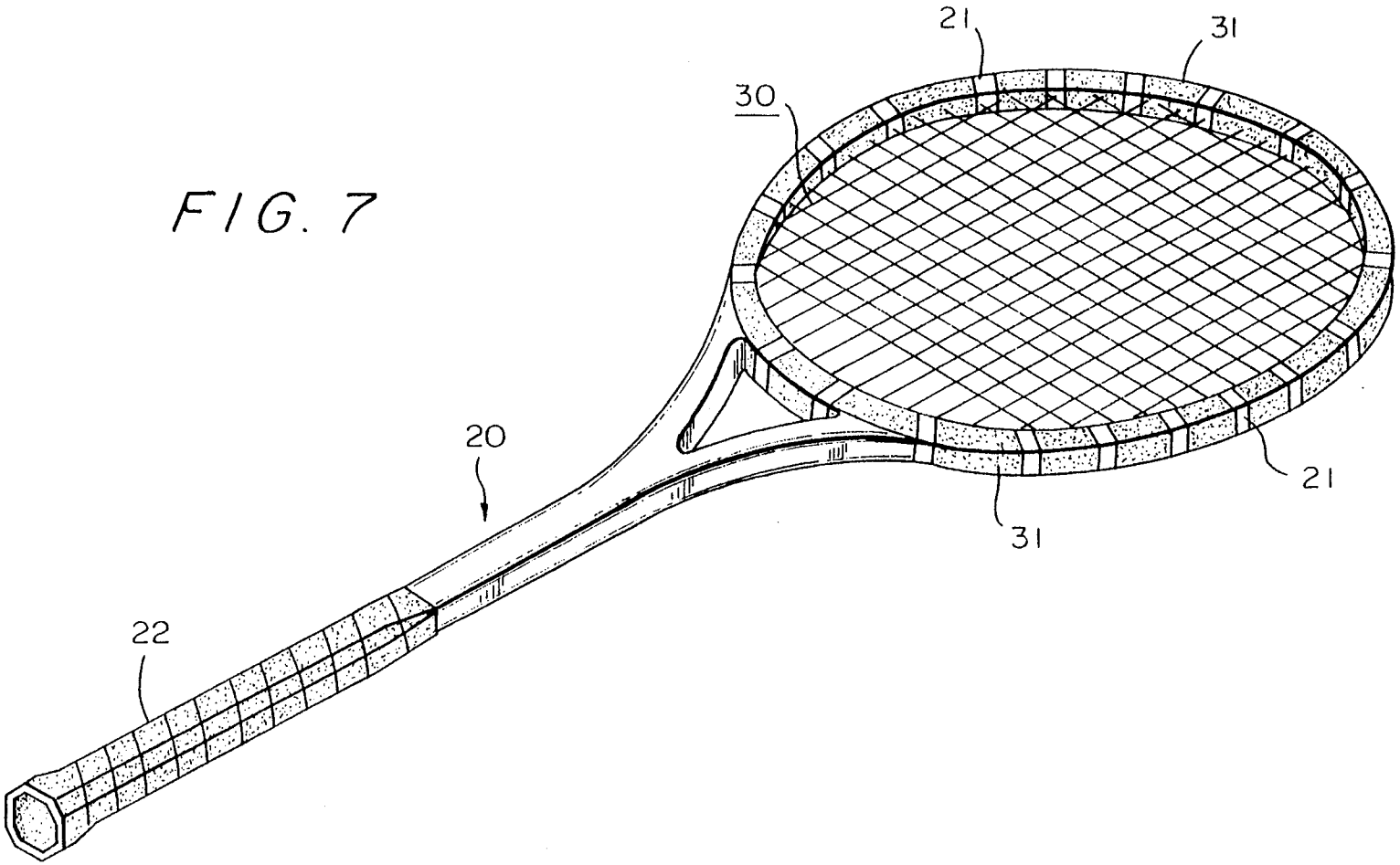
FIG. 7 shows a perspective view of a second preferred embodiment of the present invention.

As shown in FIG. 7, the second embodiment of the present invention is similar to the first preferred embodiment of the present invention, with the only difference being that the former has a frame 21 which is wrapped up by the wrapping portion 31 at intervals.

Figure 8:
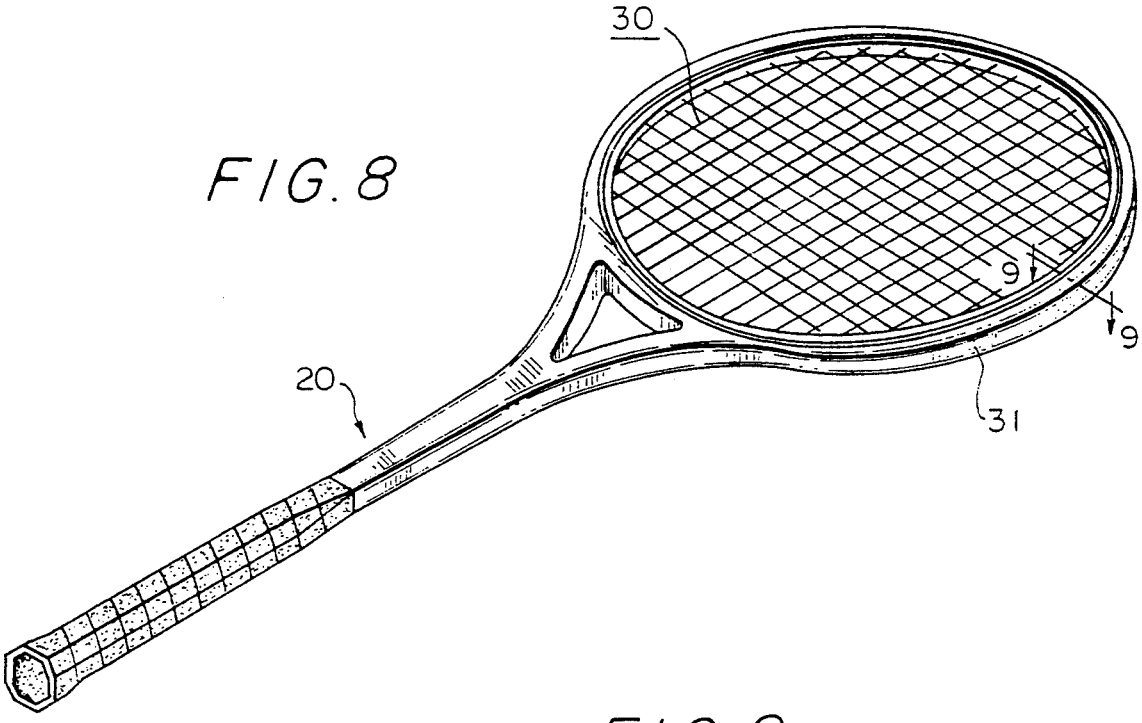
FIG. 8 shows a perspective view of a third preferred embodiment of the present invention.
Figure 9:
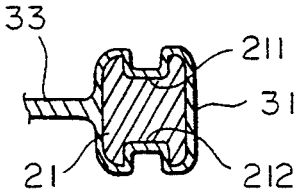
FIG. 9 shows a sectional view of a portion taken along the line 9—9 as shown in FIG. 8.

Now referring to FIGS. 8 and 9, the third preferred embodiment of the present invention is shown to comprise a head frame 21, which is provided at the center of the top thereof with a recess 211 and at the center of the bottom thereof with another recess 212. The recesses 211 and 212 are disposed throughout the head frame 21, so as to give an added strength of holding the wrapping portion 31 by the head frame 21.

Figure 10:
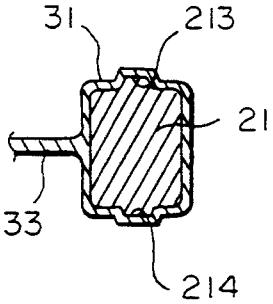
FIG. 10 shows a partial sectional view of a fourth preferred embodiment of the present invention.

As illustrated in FIG. 10, the fourth preferred embodiment of the present invention comprises a head frame 21, which is provided at the center of the top thereof with a projection 213 and at the center of the bottom thereof with another projection 214. The projections 213 and 214 are so disposed throughout the head frame 21 as to give the head frame 21 an added strength to hold securely the wrapping portion 31.

Figure 11:
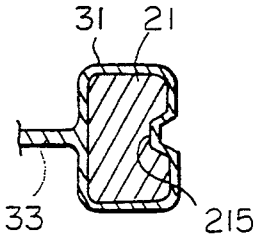
FIG. 11 shows a partial sectional view of a fifth preferred embodiment of the present invention.

Referring to FIG. 11, the fifth preferred embodiment of the present invention is shown to comprise a head frame 2 having an outer frame provided with a recess 215 of a predetermined shape. In other words, the head frame 21 of the fifth preferred embodiment of the present invention comprises a plurality of recesses 215 of a predetermined shape. The recess 215 serves as a means to help fasten securely the wrapping portion 31 to the head frame 21.

Figure 12:
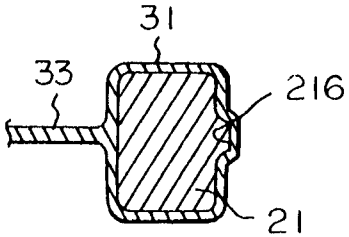
FIG. 12 shows a partial sectional view of a sixth preferred embodiment of the present invention.

As shown in FIG. 12, the sixth preferred embodiment of the present invention comprises a head frame 21 with an outer frame provided thereon with a projection 216 of a predetermined shape. In other words, the outer frame of the head frame 21 of the sixth preferred embodiment of the present invention is provided thereon with a plurality of projections 216 of a predetermined shape. Such projections 216 serve to hold firmly the wrapping portion 31 onto the head frame 21.

Figure 13:
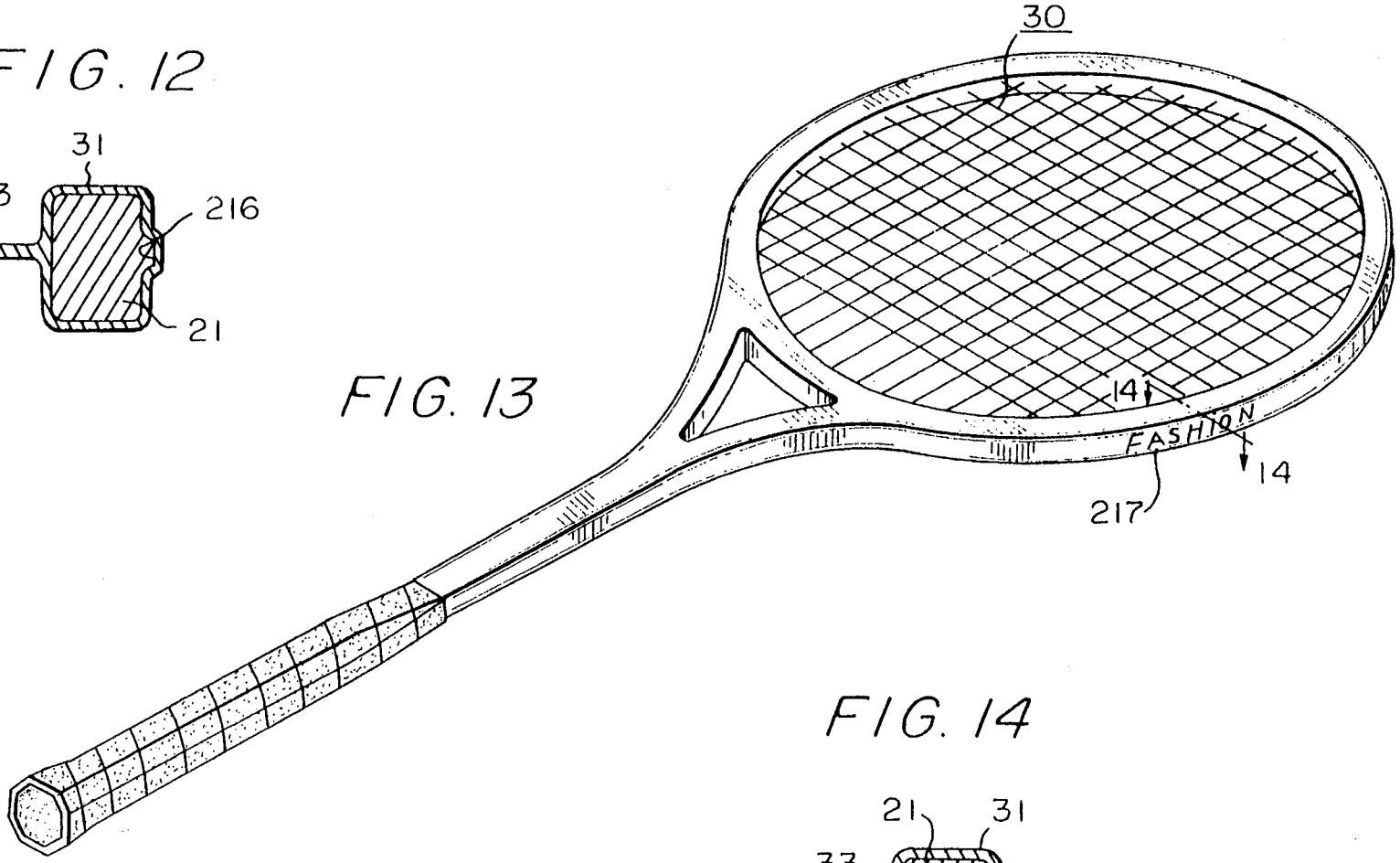
FIG. 13 shows a perspective view of a seventh preferred embodiment of the present invention.
Figure 14:
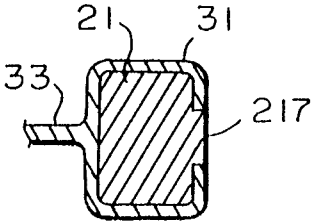
FIG. 14 shows a sectional view of a portion taken along the line 14—14 as shown in FIG. 13.

As shown in FIGS. 13 and 14, the seventh preferred embodiment of the present invention comprises a head frame with an outer frame embossed thereon with a word or FIG. 217. When the network 30 of the head frame 21 is formed by injection molding, the word or FIG. 215 remains uncovered. However, the outer surface of the wrapping portion 31 is kept on the same level as the outer surface of the word or FIG. 217. The head frame 21 and the network 30 may be of different colors. The word or FIG. 217 may serve to give an added esthetic effect to the game racket 20 of the present invention. In addition, the outer frame of the head frame 21 may be embossed with a trademark of the game racket 20 so as to give an added commercial value to the game racket 20. The word or FIG. 217 may be embossed at the top end or the bottom end of the head frame 21.

While the invention has been described in connection with what is presently considered to be the most practical and preferred embodiments, it is to be understood that the invention is not to be limited to the disclosed embodiments but on the contrary, is intended to cover various modifications and equivalent arrangements included within the spirit and scope of the appended claims which scope is to be accorded the broadest interpretation so as to encompass all such modifications and equivalent structures.

What is claimed is:

1. A game racket comprising a head frame and a handle extending downwards from a bottom end of said head frame; wherein said head frame further has a grid made of a plastic material of excellent elasticity and structural strength by injection molding in a molding tool in which said head frame is disposed, said grid having a wrapping portion of an appropriate thickness, said wrapping portion wrapped around an outer peripheral surface of said head frame, said grid having a ball-striking surface made up of a plurality of horizontal strings and longitudinal strings, wherein said longitudinal strings and said horizontal strings intersect to form a plurality of intersections, each of which has four corners provided respectively with a reinforcing portion of arcuate construction; and wherein said longitudinal strings and said horizontal strings meet respectively with an inner circumferential surface of said wrapping portion to form a plurality of connecting places provided respectively on said inner circumferential surface thereof with a reinforcing portion of arcuate construction at said connecting places.

2. A game racket according to claim 1, wherein said head frame has a top planar surface and a bottom planar surface, which are provided respectively with at least one recess which circumscribes said head frame, said wrapping portion wrapped around said head frame in engagement with each said at least one recess.

3. A game racket according to claim 1, wherein said head frame has a top planar surface and a bottom planar surface, which are provided thereon respectively with at least one projection which circumscribes said head frame, said wrapping portion wrapped around said head frame in contact with each said projection.

4. A game racket according to claim 1, wherein said outer circumferential surface lies between a top planar surface and a bottom planar surface and is provided with at least one recess circumscribing said outer circumferential surface, said wrapping portion wrapped around said head frame in engagement with said at least one recess.

5. A game racket according to claim 1, wherein said outer circumferential surface lies between a top planar surface and a bottom planar surface and is provided with at least one projection circumscribing said outer circumferential surface, said wrapping portion wrapped around said head frame in engagement with said at least one projection.

6. A game racket according to claim 1, wherein said outer circumferential surface is embossed thereon with a word or figure, which is not covered by said wrapping portion, with said word or figure having an outer surface that is kept on the same level as an outer surface of said wrapping portion; and wherein said head frame and said network are of different colors.

7. A game racket according to claim 1, wherein said wrapping portion wraps up entirely said outer peripheral surface of said head frame.

8. A game racket according to claim 7, wherein said head frame has a top planar surface and a bottom planar surface, which are provided respectively with at least one recess which circumscribes said head frame, said wrapping portion wrapped around said head frame in engagement with each said at least one recess.

9. A game racket according to claim 7, wherein said head frame has a top planar surface and a bottom planar surface, which are provided thereon respectively with at least one projection which circumscribes said head frame, said wrapping portion wrapped around said head frame in contact with each said projection.

10. A game racket according to claim 7, wherein said outer circumferential surface lies between a top planar surface and a bottom planar surface and is provided with at least one recess circumscribing said outer circumferential surface of said head frame, said wrapping portion wrapped around said head frame in engagement with said at least one recess.

11. A game racket according to claim 7, wherein said outer circumferential surface lies between a top planar surface and a bottom planar surface and is provided with at least one projection circumscribing said outer circumferential surface, said wrapping portion wrapped around said head frame in engagement with said at least one projection.

12. A game racket according to claim 7, wherein said outer circumferential surface is embossed thereon with a word or figure, which is not covered by said wrapping portion, with said word or figure having an outer surface that is kept on the same level as an outer surface of said wrapping portion; and wherein said head frame and said network are of different colors.

13. A game racket according to claim 1, wherein said wrapping portion wraps up at intervals along said outer peripheral surface of said head frame.

14. A game racket according to claim 13, wherein said head frame has a top planar surface and a bottom planar surface, which are provided respectively with at least one recess which circumscribes said head frame, said wrapping portion wrapped around said head frame in engagement with each said at least one recess.

15. A game racket according to claim 13, wherein said head frame has a top planar surface and a bottom, which are provided thereon respectively with at least one projection which circumscribes said head frame, said wrapping portion wrapped around said head frame in contact with each said projection.

16. A game racket according to claim 13, wherein said outer circumferential surface lies between a top planar surface and a bottom planar surface and is provided with at least one recess circumscribing said outer circumferential surface, said wrapping portion wrapped around said head frame in engagement with said at least one recess.

17. A game racket according to claim 13, wherein said outer circumferential surface lies between a top planar surface and a bottom planar surface and is provided with at least one projection circumscribing said outer circumferential surface, said wrapping portion wrapped around said head frame in engagement with said at least one projection.

* * * * *